US006756952B1

(12) United States Patent
Decaux et al.

(10) Patent No.: US 6,756,952 B1
(45) Date of Patent: Jun. 29, 2004

(54) LIGHT DISPLAY PANEL CONTROL

(75) Inventors: Jean-Claude Decaux, 88 Boulevard Maurice Barres, 92200 Neuilly sur Seine (FR); Jacques Le Gars, Gambais (FR)

(73) Assignee: Jean-Claude Decaux, Neuilly sur Seine (FR)

( * ) Notice: Subject to any disclaimer, the term of this patent is extended or adjusted under 35 U.S.C. 154(b) by 0 days.

(21) Appl. No.: 09/623,534

(22) PCT Filed: Mar. 3, 1999

(86) PCT No.: PCT/FR99/00475

§ 371 (c)(1),
(2), (4) Date: Feb. 15, 2002

(87) PCT Pub. No.: WO99/45525

PCT Pub. Date: Sep. 10, 1999

(30) Foreign Application Priority Data

Mar. 5, 1998 (FR) ..... 98 02694

(51) Int. Cl.[7] ..... G09G 3/32
(52) U.S. Cl. ..... 345/83
(58) Field of Search ..... 345/83, 82, 76

(56) References Cited

U.S. PATENT DOCUMENTS 5,493,183 A 2/1996 Kimball ..... 315/308
5,812,105 A * 9/1998 Van de Ven ..... 345/83
5,936,599 A * 8/1999 Reymond ..... 345/82
6,618,031 B1 * 9/2003 Bohn et al. ..... 345/83

FOREIGN PATENT DOCUMENTS

EP 0 702 347 3/1996
GB 2 106 299 4/1983

OTHER PUBLICATIONS

French Preliminary Search Report dated May 25, 1999, French Application FR 9900475.

* cited by examiner

*Primary Examiner*—Xiao Wu
*Assistant Examiner*—Kevin M. Nguyen
(74) *Attorney, Agent, or Firm*—Marshall, Gerstein & Borun LLP

(57) ABSTRACT

The disclosure concerns a light display panel with a matrix of pixels each comprising three monochrome electroluminescent diodes of three colors. The diodes are controlled by a control circuit delivering electrical power P to each diode, said electrical power being expressed in the form P–k.Pr, wherein Pr is a reference electrical power particular to the diodes of each color and k is a coefficient selected according to the display to be presented. Over the course of time the reference electrical power is subjected to different variations depending on the colors, to compensate for the aging of the diodes.

7 Claims, 1 Drawing Sheet

LIGHT DISPLAY PANEL CONTROL

FIELD OF THE DISCLOSURE

The present invention relates to illuminated display panels.

BACKGROUND OF THE DISCLOSURE

More specifically, the invention relates to an illuminated display panel having at least one matrix of light pixels, each pixel comprising at least three monochrome electric light elements emitting light respectively in at least three complementary colors, operation of the light elements being controlled by an electronic control system which determines an electrical power P applied to each light element, this electrical power being expressed in the form of P=k.Pr, where:

Pr is a reference electrical power specific to the light elements of each color and k is a real number at least equal to 0, selected as a function of the display to be presented on the panel.

Known display panels of this type enable illuminated displays to be presented in color.

However, the light elements are generally provided in the form of electroluminescent diodes of differing technologies depending on the colors, which means that aging in these diodes differs from one color to another. This results in a drift in the colors of the illuminated panel over a period of time.

The particular objective of this invention is to overcome this disadvantage.

SUMMARY OF THE DISCLOSURE

To this end, the invention proposes an illuminated display panel of the type in question essentially characterized in that the electronic control system is set up to vary the reference electrical power Pr specific to the light elements of each color over time, in accordance with a different predetermined variation depending on the colors, in order to compensate, at least partially, for the effects of aging of the light elements.

As a result of these features, any drift in the colors of the illuminated panel over time is prevented or at least reduced.

In preferred embodiments of the invention, one and/or the other of the following features may be incorporated:

the electronic control system is set up so as to measure and store an operating time of the light elements, this electronic control system also having numerical values in memory enabling a theoretical reference electrical power Pt to be determined depending on the operating time of said light elements, this theoretical reference electrical power differing depending on the colors, and said electronic control system being set up to determine the reference electrical power Pr corresponding to each color by means of the formula: Pr=a.Pt+b, where a is a positive constant that is not zero and b is a constant at least equal to 0, a and b being specific to each color;

a=1; b=0;

a=1 and b is a value determined on the basis of experimental light intensity measurements conducted on the panel;

b=0 and a is a value determined on the basis of experimental light intensity measurements conducted on the panel;

the operating time of the light elements is measured per group of light elements and the theoretical reference electrical power Pt is also determined for the same groups of light elements;

the values a and b are common to all the light elements of a same color belonging to the panel;

Other features and advantages of the invention will become clear from the following description of one of its embodiments, given by way of example and not restrictive in any respect, in conjunction with the appended drawings.

DETAILED DESCRIPTION OF THE DISCLOSURE

The same reference numbers are used in the different drawings to denote the same or similar elements.

Figure 1:
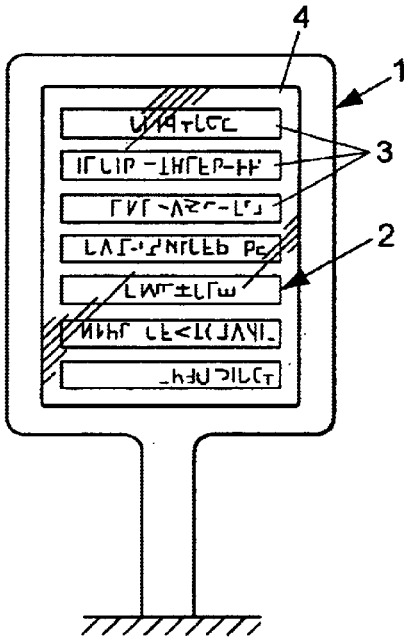
FIG. 1 shows a partial block diagram of one embodiment of an illuminated display panel as proposed by the invention.

FIG. 1 illustrates an example of an illuminated color display panel 1 as proposed by the invention, which might be installed in a city area to broadcast advertising information to users of the public highway.

The display panel 1 comprises a transparent front face 2, covering matrices 3 of light elements disposed on an opaque background 4.

Depending on the circumstances, the display panel might have only one matrix 3 of light elements, extending substantially across the entire front face of the panel.

Figure 2:
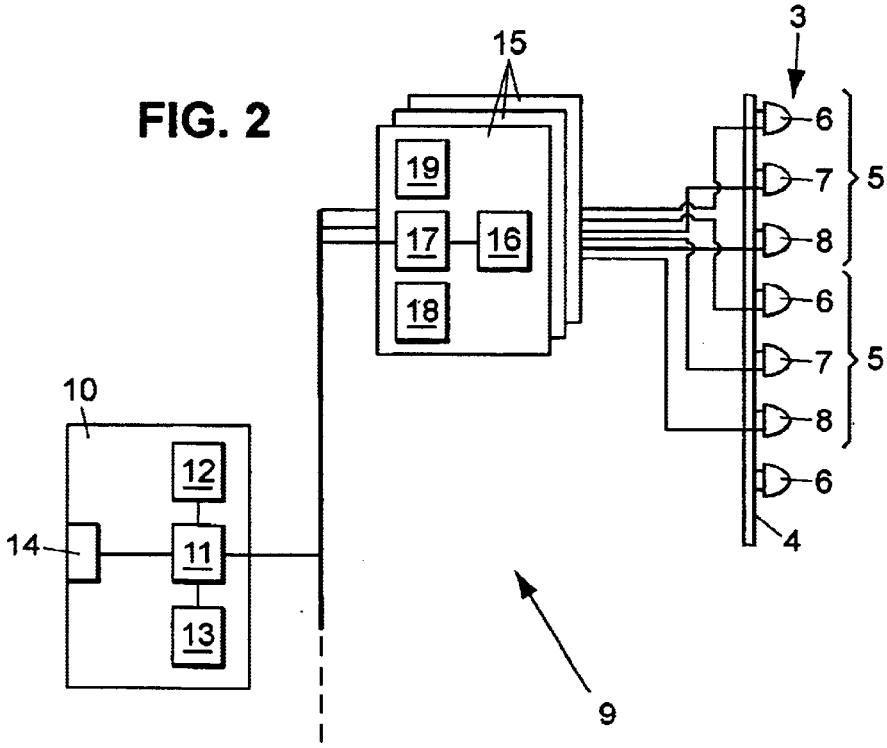
FIG. 2 shows a partial block diagram of the electronic control system of the display panel illustrated in FIG. 1.

As schematically illustrated in FIG. 2, each matrix 3 of light elements is made up of a large number of pixels 5 or illuminated dots, of small dimensions, each pixel 5 comprising three electroluminescent diodes 6, 7, 8 of three different colors, for example red, green blue. Optionally, each pixel may comprise more than three diodes, for example several diodes mounted in series for each of the three colors.

The different electroluminescent diodes 6, 7, 8 are controlled by an electronic control circuit 9, which comprises:

a general control device 10 comprising, for example, a microprocessor 11 connected to a clock 12 and a memory 13, as well as a communication interface 14 (serial interface, telephone network link, radio network link or other) enabling the images which are to be displayed on the panel 1 to be loaded into the memory 13, and a plurality of elementary control devices 15, each of which individually controls the electroluminescent diodes of a same color in a given sub-set of pixels, for example a "square" of 16 pixels by 16 pixels (the electroluminescent diodes 6, 7, 8 belonging to a same sub-set of pixels are controlled by three elementary control devices 15 in total), each elementary control device comprising, for example, a power circuit 16 controlled by a microprocessor or micro-controller 17, in turn connected firstly to a memory 18 and secondly to a clock 19.

The microprocessor 17 controls the electrical power applied by the power circuit 16 to each electroluminescent diode individually, determining the cyclical operating time of this diode.

The display panel described above operates as follows.

Figure 3:
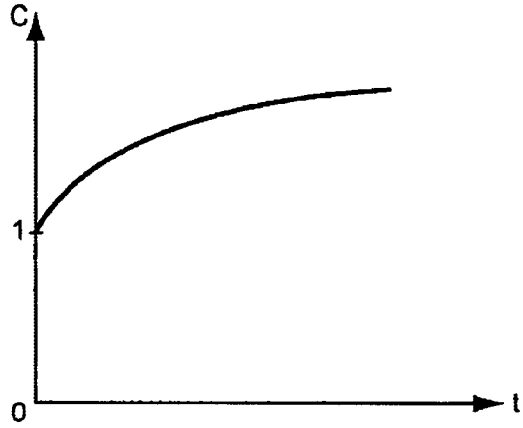
FIG. 3 shows an example of a correction curve for the reference electrical power of electroluminescent diodes of a same color controlled by a same elementary control circuit.

When this display panel is installed or when a sub-set of pixels and corresponding elementary control circuits 15 are replaced, the memory 18 of each elementary control circuit comprises:

an initial reference electrical power PO, the value of PO being different for the three elementary control circuits in question, and said initial reference power being determined so that when the three electroluminescent diodes 6, 7, 8 of each pixel are supplied with their corresponding initial reference electrical power, the pixels in question appear as white, an operating counter, initially set to 0, in which the microprocessor 17 stores the mean operating time t of the electroluminescent diodes controlled by the elementary control device 15 in question from the moment it comes into service, a table of correction factors c depending on the mean operating time t, which are different for the three elementary control circuits 15 corresponding to the three colors of the sub-set of pixels in question, these factors c being equal to 1 for t=0 and increasing with t (see FIG. 3) and said factors c enabling a theoretical reference electrical power Pt=c.PO to be determined which at least partially compensates for aging of the diodes, and a correction value b initially equal to 0, then determined experimentally from time to time as described below.

Depending on the mean operating time t corresponding to each elementary control device 15, the microprocessor 17 of this device is programmed to calculate a corrected reference electrical power Pr=c.PO+b.

The reference electrical power values Pr for the three elementary control circuits 15 of a same sub-set of pixels are such that when the three electroluminescent diodes 6, 7 8 of a same pixel are all powered at their corresponding reference electrical power Pr, the pixels in question appear white or substantially white.

Furthermore, each display likely to be presented by is the panel 1 corresponds in practice to a set of coefficients k each ranging between 0 and 100%, corresponding to the percentage of the reference electrical power Pr which must be applied to the electroluminescent diodes (each coefficient k corresponds to one color of a pixel).

These coefficients k are stored in the memory 13 of the general control circuit 10 and are transmitted to the different elementary control devices 15 when a given display has to be presented by the panel 1.

Depending on the coefficients k received for each pixel and for each color, each elementary control device 15 applies to the different electroluminescent diodes which it controls a power P=k.Pr, where Pr is the above-mentioned reference electrical power.

From time to time, for example once a year, predetermined patterns are displayed on the panel 1, for example successive monochrome displays, in the three colors.

Accordingly, for the display panel 1 as a whole, the average light intensity of the electroluminescent diodes of a same color is determined when all the elementary control circuits 15 corresponding to this color are applying the reference power Pr to their electroluminescent diodes.

If said light intensity differs from the normal light intensity, the resultant deduction is that the reference electrical power Pr should on average be increased or reduced by a certain value ΔPr so that the light intensity will assume its normal value (ΔPr is positive if the reference power has to be increased and negative if it has to be reduced).

This value ΔPr, determined for each color, is communicated to the microprocessor 11 of the general control circuit 10, for example by means of a control box connected to the communication interface 14, and the microprocessor 11 transmits this value ΔPr to the microprocessors 17 of the different corresponding elementary control devices 15 as a function of the corrected color.

Each corresponding microprocessor 17 then adds the value ΔPr in question to the value b previously stored in the memory 18.

Depending on the circumstances, this experimental correction process could be suppressed, in which case the value b would be zero.

Optionally, the correction value b could be deleted and replaced by a correction factor a, such that Pr=a.c.PO, a being initially equal to 1 when each elementary control device 15 and the corresponding electroluminescent diodes are installed and a being multiplied by (Pr+ΔP)/Pr during the experimental correction process described above.

It would also be possible to use a correction formula of the type Pr=a.c.PO+b, where a and b would be experimentally determined as above.

What is claimed is:

1. An illuminated display panel having at least one matrix of light pixels, each pixel comprising at least three monochrome electric light elements emitting light respectively in at least three complementary colors, operation of the light elements being controlled by an electronic control system which determines an electrical power P applied to each light element, it being possible to express this electric power in the form of P=k.Pr, where:

Pr is a reference electrical power specific to the light elements of each color and k is a real number at least equal to 0, chosen as a function of the display to be presented on the panel, characterized in that the electronic control system is set up to vary the reference electrical power Pr specific to the light elements of each color over time, in accordance with a different predetermined variation depending on the colors, in order to compensate, at least partially, for the effects of aging of the light elements, so as to avoid a drift in the colors of displays displayed by the panel.

2. An illuminated display panel as claimed in claim 1, in which the electronic control system is set up to measure and store in memory an operating time of the light elements, this electronic control system also having numerical values in memory enabling a theoretical reference electrical power Pt to be determined as a function of the operating time of said light elements, this theoretical reference electrical power being different depending on the colors and said electronic control system being set up to determine the reference electrical power Pr corresponding to each color by means of the formula; Pr=a.Pt+b, where a is a positive constant that is not zero and b is a constant at least equal to 0, a and b being specific to each color.

3. An illuminated display panel as claimed in claim 2, in which a=1 and b=0.

4. An illuminated display panel as claimed in claim 2, in which a=1 and b is a value determined following experimental light intensity measurements conducted on the panel.

5. An illuminated display panel as claimed in claim 2, in which b=0 and a is a value determined following experimental light intensity measurements conducted on the panel.

6. An illuminated display panel as claimed in claim 2, in which the operating time of the light elements is measured per group of light elements and the theoretical reference electrical power Pt is also determined for the same groups of light elements.

7. An illuminated display panel as claimed in claim 6, in which the values a and b are common to all the light elements of a same color belonging to the panel.

* * * * *